US007927145B1

(12) United States Patent
Chang

(10) Patent No.: US 7,927,145 B1
(45) Date of Patent: Apr. 19, 2011

(54) USB FEMALE CONNECTOR

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/941,116

(22) Filed: Nov. 8, 2010

(30) Foreign Application Priority Data

Dec. 28, 2009 (TW) ..... 098224516

(51) Int. Cl.
*H01R 13/648* (2006.01)

(52) U.S. Cl. ..... 439/607.31

(58) Field of Classification Search ..... 439/607.01
See application file for complete search history.

*Primary Examiner* — Briggitte R Hammond

(74) *Attorney, Agent, or Firm* — Chun-Ming Shih; HDLS IPR Services

(57) ABSTRACT

A USB female connector includes an insulation body, a circuit board, connecting terminals and electrical-conductive terminals. The insulation body is provided with a trough and a plurality of terminal slots located on a lower edge of the trough. The circuit board is disposed through the trough and has a first surface and a second surface opposite to the first surface. A front end of the first surface is arranged with a plurality of golden fingers. One ends of the connecting terminals are fixed to a rear end of the second surface and electrically connected to the golden fingers. The electrical-conductive terminals are disposed through the terminal slots. A front end of each of the electrical-conductive terminals has an electrical-conductive portion located in rear of the golden fingers. By this structure, the volume of the female connector is reduced to thereby conform to the requirements for compact design.

10 Claims, 4 Drawing Sheets

USB FEMALE CONNECTOR

BACKGROUND OF THE INVENTION

1. Field of the Invention

The present invention relates to a connector, in particular to a USB female connector.

2. Description of Prior Art

Universal Serial Bus (referred to as "USB" hereinafter) is a signal transmission interface which is most widely used in peripheral products of personal computers. The USB is originally proposed by Intel and Microsoft, and three versions of USB (USB 1.0, USB 1.1, and USB 2.0) have been developed until now. USB 1.0 is configured to achieve a low-speed signal transmission rate of 1.5 Mbps. USB 1.1 is configured to achieve a full-speed signal transmission rate of 12 Mbps. USB 2.0 is configured to achieve a high-speed signal transmission rate of 480 Mbps.

However, with the rapid development of electronic industries, even the signal transmission rate of USB 2.0 cannot satisfy the demands of certain advanced electronic industries. Thus, a novel signal transmission interface of USB 3.0 is developed. The USB 3.0 is configured by adding two pairs of differential terminals and a grounding terminal to the original four terminals of the USB 2.0. As a result, the USB 3.0 has nine terminals and thus its signal transmission rate can be increased up to 5 Gbps.

According to prior art, an existing female connector of the USB 3.0 standard includes an insulation body. A tongue plate extends from a front end of the insulation body. Electrical-conductive portions for the additional five terminals and other electrical-conductive portions for the original four terminals are provided on the opposite surfaces of the tongue plate respectively. Since the positions of these nine terminals have been standardized, the additional five terminals are located in a higher level than that of the original four terminals. That is, the nine terminals are arranged in two rows in a vertical direction, thereby avoiding short circuit.

However, since the peripheral products and associated connectors of the computers are required to be made more and more compact, arranging nine terminals on a small tongue plate really increases the difficulty in manufacturing and assembling the USB 3.0 female connector. As a result, the volume of the USB female connector cannot be made compact further.

Therefore, it is an important issue for the present Inventor to solve the above-mentioned problems.

SUMMARY OF THE INVENTION

The present invention is to provide a USB female connector, which has a simplified structure and reduced volume to thereby conform to the requirements for compact design.

The present invention is to provide a USB female connector, including: an insulation body provided with a trough and a plurality of terminal slots located on a lower edge of the trough; a circuit board disposed through the trough and having a first surface and a second surface opposite to the first surface, a front end of the first surface being arranged with a plurality of golden fingers; a plurality of connecting terminals with its one end fixed to a rear end of the second surface and electrically connected to the golden fingers; and a plurality of electrical-conductive terminals disposed through the terminal slots, a front end of each of the electrical-conductive terminals having a electrical-conductive portion located in rear of the golden fingers.

In comparison with prior art, the present invention has advantageous features as follows. The front end of the circuit board is arranged with the golden fingers and the rear end of the circuit board is provided with the connecting terminals electrically connected to the golden fingers, thereby replacing the five electrical-conductive terminals in a conventional USB female connector. Further, the insulation body is not provided with a tongue plate for allowing nine terminals to be arranged thereon, the structure of the USB female connector is simplified greatly to thereby conform to the requirements for compact design. On the other hand, since the USB female connector of the present invention has a simplified structure and fewer components, the production cost and the time for assembly can be reduced.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

First of all, directional terms "front", "forward", "rear" and "rearward" mentioned herein are defined as follows. The direction toward which an opening of a USB female connector is provided for allowing a male connector to be inserted therein is defined as the "forward" direction, and the "rearward" direction is opposite to the "forward" direction.

Figure 1:
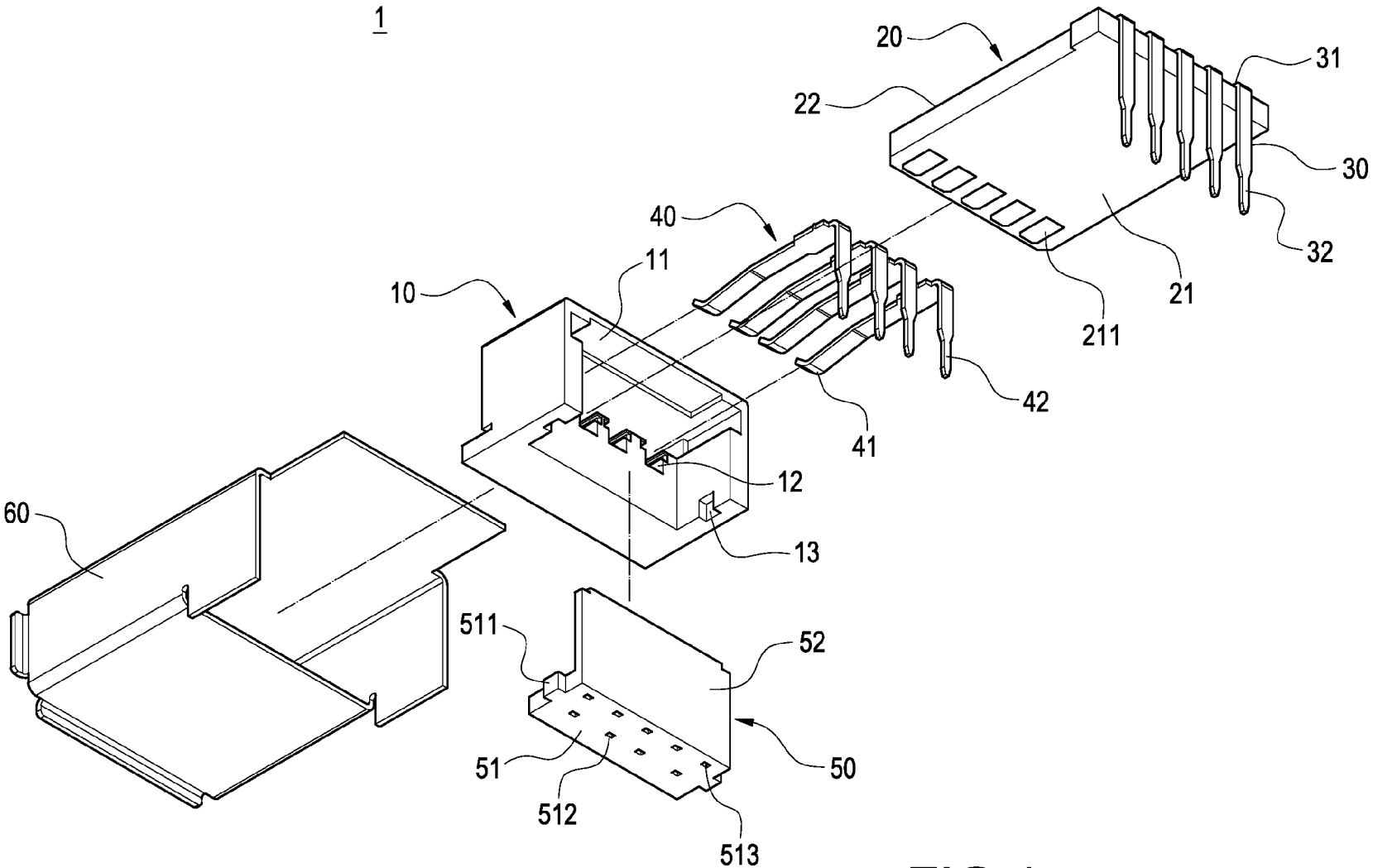
FIG. 1 is an exploded perspective view of the present invention.

Please refer to FIG. 1, which is an exploded perspective view of the present invention. The present invention provides a USB female connector 1 including an insulation body 10, a circuit board 20, a plurality of connecting terminals 30, a plurality of electrical-conductive terminals 40, a fixing base 50 and a metallic casing 60.

The insulation body 10 is made of insulation materials. The insulation body 10 is provided with a trough 11 in the front-to-back direction and a plurality of terminal slots 12 located on a lower edge of the trough 11. In the present embodiment, there are four terminal slots 12. The trough 11 and the terminal slots 12 extend through the front and rear ends of the insulation body 10.

The circuit board 20 is a thin printed circuit board. The width of the circuit board 20 is substantially identical to that of the trough 11, so that the circuit board 20 is disposed through the trough 11. The circuit board 20 has a first surface 21 and a second surface 22 opposite to the first surface 22. In the present embodiment, as shown in FIG. 1, the first surface 21 is the lower surface of the circuit board 20, and the second surface 22 is the upper surface of the circuit board 20. The front end of the first surface 21 is arranged with a plurality of golden fingers 211. These golden fingers 211 are made of copper coils and formed on the first surface 21. In the present embodiment, there are five golden fingers.

The connecting terminals 30 are made of electrical-conductive metallic materials. One end 31 of the connecting terminal 20 is fixed to the rear end of the second surface 22 and electrically connected to the golden finger 211 arranged on the first surface 21. There are five connecting terminals 30. Further, one end of the connecting terminal 30 away from the second surface is provided with a soldering portion 32. The soldering portion 32 is bent downwards to extend below the rear end of the circuit board 20.

Figure 2:
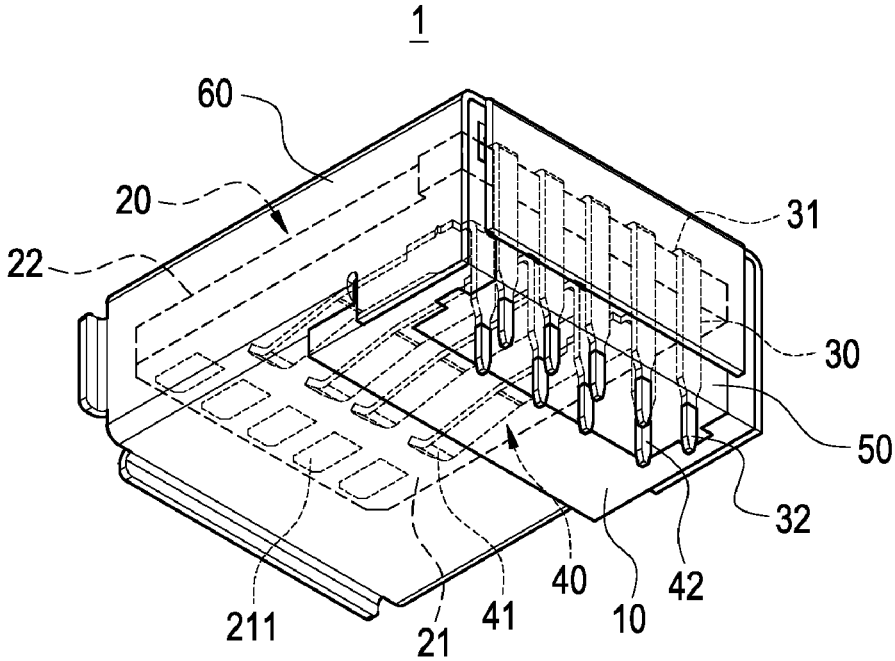
FIG. 2 is an assembled perspective view of the present invention.
Figure 3:
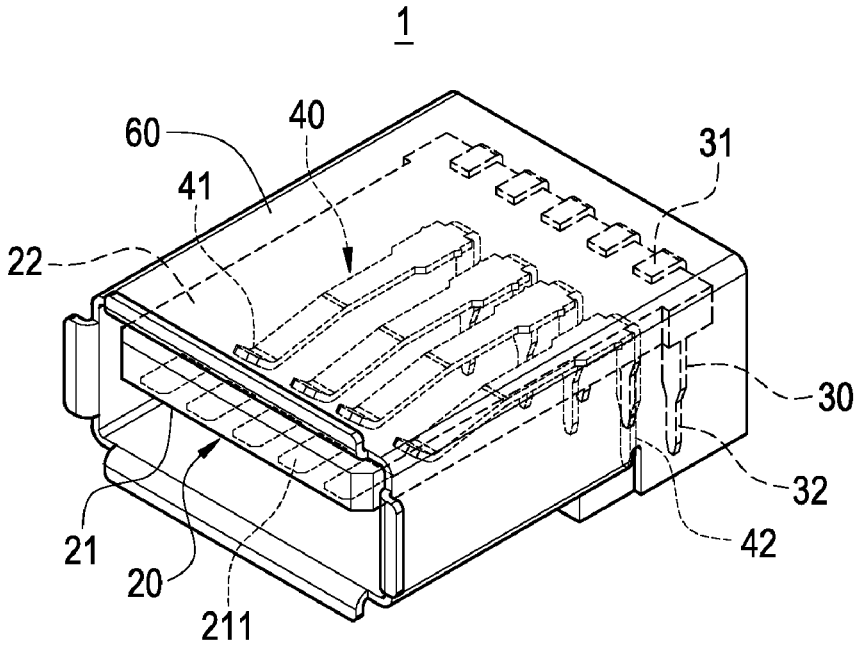
FIG. 3 is an assembled perspective view of the present invention from another viewing angle.
Figure 4:
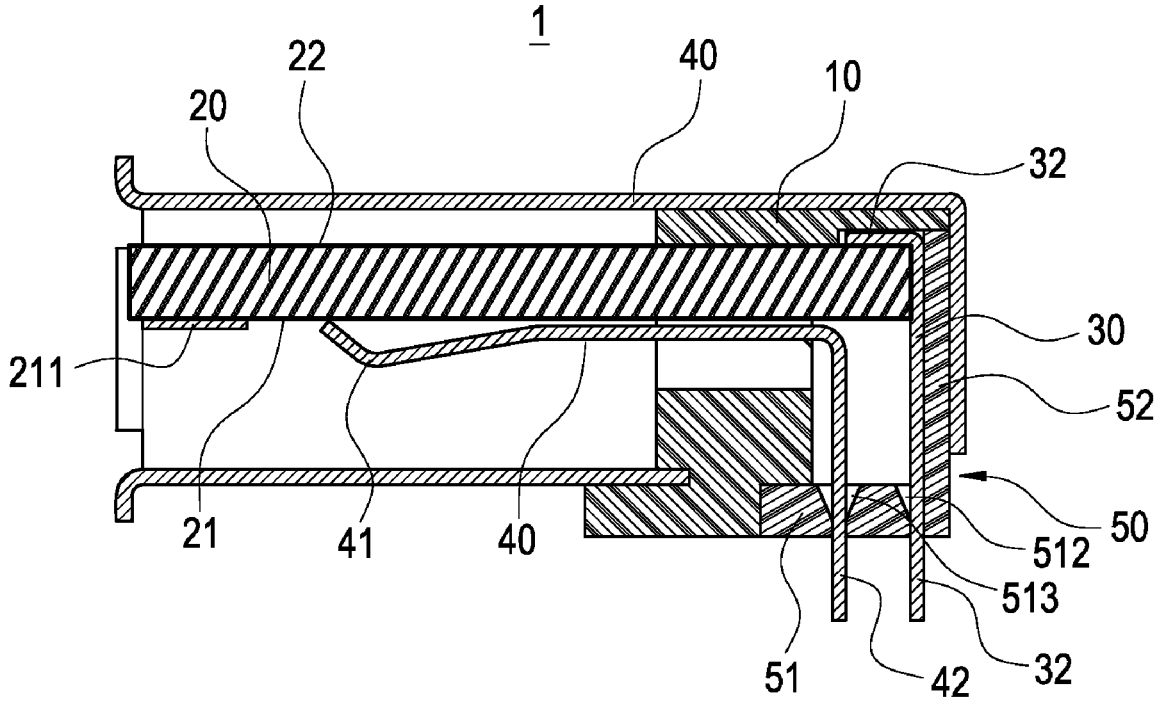
FIG. 4 is an assembled cross-sectional view of the present invention.

The electrical-conductive terminals 40 are also made of electrical-conductive metallic materials. The electrical-conductive terminals 40 are disposed through the terminal slots 12 of the insulation body 10 respectively. There are four electrical-conductive terminals 40. The front end of each electrical-conductive terminal 40 has an electrical-conductive portion 41, and the rear end thereof has a soldering portion 42. When the electrical-conductive terminals 40 are disposed through the terminal slots 12 of the insulation body 10, the electrical-conductive portion 41 of each electrical-conductive terminal 40 protrudes from the front end of the insulation body 10, and the soldering portion 42 protrudes from the rear end of the terminal slot 12 to be bent downwards. As shown in FIGS. 2 and 3, the electrical-conductive portion 41 is located in rear of the golden finger 211 on the first surface 21. As shown in FIG. 4, the electrical-conductive portion 41 is not adhered to the first surface 21, but located below the first surface 21. As a result, the electrical-conductive portions 41 are not located in the same level as that of the golden fingers 211 on the first surface 21.

The fixing base 50 has a bottom plate 51 and a rear cover plate 52 extending vertically and upwards from the bottom plate 51. Both sides of the bottom plate 51 are provided with posts 511. The surface of the bottom plate 51 is provided with two rows of insertion holes 512 and 513. The number of the front-row insertion holes 512 is four, and the soldering portions 42 of the electrical-conductive terminals 40 are inserted into the front-row insertion holes 512. The number of the rear-row insertion holes 513 is five, and the soldering portions 32 of the connecting terminals 30 are inserted into the rear-row insertion holes 513. Therefore, the front-row insertion holes 512 and the rear-row insertion holes 513 are located to correspond to the soldering portions 42 of the electrical-conductive terminals 40 and the soldering portions 32 of the connecting terminals 30 respectively. The soldering portions 42 of the electrical-conductive terminals 40 and the soldering portions 32 of the connecting terminals 30 are bent downwards to pass through the front-row insertion holes 512 and the rear-row insertion holes 513 respectively. Finally, the soldering portions 42 and 32 are electrically soldered to an external circuit board 70 (FIG. 5), so that the female connector 1 of the present invention can be electrically connected to the external circuit board 70.

Two inner side walls of the bottom surface of the insulation body 10 are provided with a locking trough 13 respectively for allowing the posts 511 of the bottom plate 51 to be engaged therein. Thus, when the fixing base 50 is assembled to the bottom surface of the insulation body 10, the posts 511 of the bottom plate 51 are engaged in the locking troughs 13 of the insulation body 10. In this way, the soldering portions 42 of the electrical-conductive terminals 40 and the soldering portions 32 of the connecting terminals 30 pass through the insertion holes 512 and 513 respectively. Finally, the rear cover plate 52 covers the rear end surface of the insulation body 10, thereby protecting the circuit board 20, the connecting terminals 30 and the electrical-conductive terminals 40 in the insulation body 10.

Please refer to FIG. 1 again. The metallic casing 60 is a rectangular hollow casing, which is configured to cover the outer periphery of the insulation body 10 to thereby generate a shielding effect to prevent against electromagnetic interference. Further, the metallic casing 60 is configured to protect the circuit board 20, the connecting terminals 30 and the electrical-conductive terminals 40 disposed therein.

Figure 5:
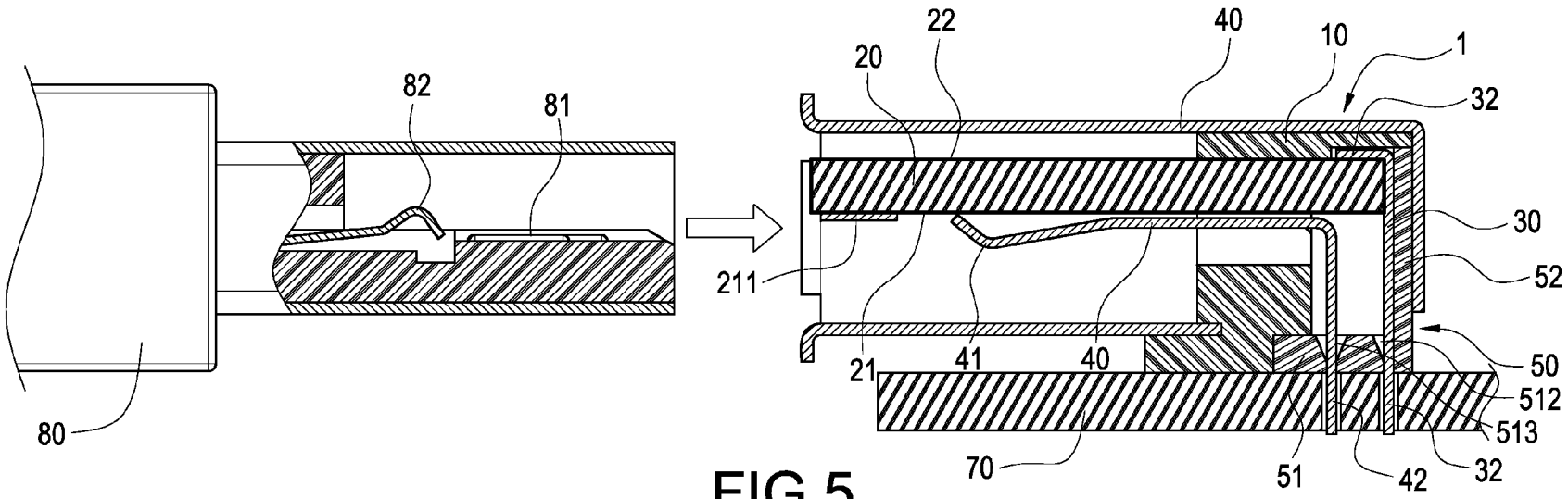
FIG. 5 is a side cross-sectional view showing a state before the USB female connector of the present invention is inserted by a male connector.
Figure 6:
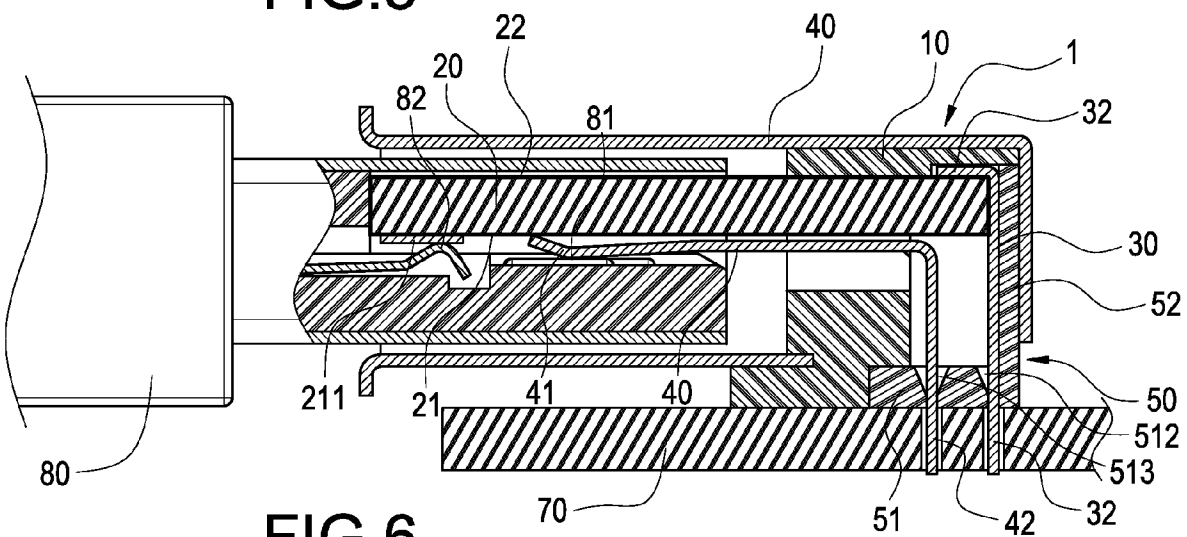
FIG. 6 is a side cross-sectional view showing a state after the USB female connector of the present invention is inserted by a male connector.

Please refer to FIGS. 5 and 6. FIG. 5 is a side cross-sectional view showing a state before the USB female connector 1 of the present invention is inserted by a male connector 80, and FIG. 6 is a side cross-sectional view showing a state after the USB female connector 1 of the present invention is inserted by the male connector 80. The male connector 80 is a conventional male connector of USB 3.0 standard, in which four first terminals 81 and five second terminals 82 are provided. It can be seen from FIG. 5 that the first terminals 81 are located below the second terminals 82, and the first terminals 81 are separated from the second terminals 82 in the front-to-back direction.

As shown in FIG. 6, when the female connector 1 of the present invention is inserted by the male connector 80, the golden fingers 211 on the first surface 21 of the circuit board 20 are brought into contact with the second terminals 82 of the male connector 80, while the electrical-conductive portions 41 of the electrical-conductive terminals 40 are brought into contact with the first terminals 81. In this way, the female connector 1 can be electrically connected to the male connector 80.

In comparison with prior art, the present invention has advantageous features as follows. The front end of the circuit board 20 is arranged with the golden fingers 211 and the rear end of the circuit board 20 is provided with the connecting terminals 30 electrically connected to the golden fingers 211, thereby replacing the five electrical-conductive terminals in a conventional USB female connector. Further, the insulation body 10 is not provided with a tongue plate for allowing nine terminals to be arranged thereon, the structure of the USB female connector 1 of the present invention is simplified greatly to thereby conform to the requirements for compact design. On the other hand, since the USB female connector 1 of the present invention has a simplified structure and fewer components, the production cost and the time for assembly can be reduced.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A USB female connector, including:

an insulation body provided with a trough and a plurality of terminal slots located on a lower edge of the trough;

a circuit board disposed through the trough and having a first surface and a second surface opposite to the first surface, a front end of the first surface being arranged with a plurality of golden fingers;

a plurality of connecting terminals each with one end fixed to a rear end of the second surface and electrically connected to the golden fingers; and a plurality of electrical-conductive terminals disposed through the terminal slots, a front end of each of the electrical-conductive terminals having an electrical-conductive portion located in rear of the golden fingers.

2. The USB female connector according to claim 1, further including a metallic casing configured to cover an outer periphery of the insulation body.

3. The USB female connector according to claim 2, wherein the electrical-conductive portions are located in a different level from that of the golden fingers provided on the first surface.

4. The USB female connector according to claim 2, wherein one end of each of the electrical-conductive terminals away from the electrical-conductive portion is formed into soldering portion, the soldering portions of the electrical-conductive terminals protrude from the rear end of the terminal slots and are bent downwards, one end of each of the connecting terminals away from the second surface is formed into soldering portion, the soldering portions of the connecting terminals are bent downwards.

5. The USB female connector according to claim 4, further including a fixing base assembled to the bottom of the insulation body, the fixing base being provided with two rows of insertion holes for allowing the soldering portions of the connecting terminals and the soldering portions of the electrical-conductive terminals to be inserted therein respectively.

6. The USB female connector according to claim 4, wherein the soldering portions of the connecting terminals and the soldering portions of the electrical-conductive terminals are electrically soldered to an external circuit board.

7. The USB female connector according to claim 2, wherein a number of the golden fingers on the first surface is five.

8. The USB female connector according to claim 7, wherein a number of the connecting terminals is five.

9. The USB female connector according to claim 8, wherein a number of the terminal slots is four.

10. The USB female connector according to claim 9, wherein a number of the electrical-conductive terminals is four.

* * * * *